US012121778B2

(12) United States Patent
Bowen

(10) Patent No.: US 12,121,778 B2
(45) Date of Patent: Oct. 22, 2024

(54) SPORTS TRAINING ACCESSORY

(71) Applicant: BALLOSTER TRAINING LLC, Carrollton, MI (US)

(72) Inventor: Brian Bowen, Saginaw, MI (US)

(73) Assignee: Balloster Training LLC, Carollton, MI (US)

( * ) Notice: Subject to any disclaimer, the term of this patent is extended or adjusted under 35 U.S.C. 154(b) by 116 days.

(21) Appl. No.: 17/930,475

(22) Filed: Sep. 8, 2022

(65) Prior Publication Data

US 2024/0082647 A1 Mar. 14, 2024

(51) Int. Cl.
*A63B 47/00* (2006.01)
*A45F 5/02* (2006.01)

(52) U.S. Cl.
CPC ..... *A63B 47/001* (2013.01); *A45F 5/021* (2013.01)

(58) Field of Classification Search
CPC .. A63B 47/001; A45F 5/021; A45F 2005/025; A45F 2005/027; Y10S 224/919
USPC ..... 224/666, 197
See application file for complete search history.

(56) References Cited

U.S. PATENT DOCUMENTS 4,079,871 A 3/1978 Sica
4,191,350 A * 3/1980 Ormond ..... A01K 97/04 248/311.2
4,256,244 A 3/1981 Gasper
4,269,338 A 5/1981 Sichel
4,396,136 A 8/1983 Stafford, Jr.
4,416,404 A 11/1983 Daniels
4,433,803 A 2/1984 Liberboim
4,836,427 A 6/1989 McManus
4,979,742 A 12/1990 DeFranco
5,289,960 A 3/1994 Kelly et al.
5,326,005 A 7/1994 Fisher
5,395,022 A * 3/1995 Vandewall ..... A63B 47/001 224/663
6,045,017 A * 4/2000 Connell ..... A45F 5/02 224/675
6,082,602 A 7/2000 Gschwind
6,193,120 B1 2/2001 Chang
6,216,933 B1 4/2001 Healy
7,424,962 B2 9/2008 Mooney
7,690,543 B1 4/2010 Edwards-Delgado et al.
8,066,148 B2 * 11/2011 Garahan ..... A45F 5/02 220/737
8,152,659 B1 4/2012 Wadley
8,172,704 B2 5/2012 Horkan
8,245,892 B2 * 8/2012 Kriner ..... A44B 11/005 224/183
2007/0257074 A1 11/2007 Harrison
(Continued)

FOREIGN PATENT DOCUMENTS

DE 202012104944 U1 1/2013
KR 200485205 12/2017
WO 9954002 10/1999

*Primary Examiner* — Adam J Waggenspack
(74) *Attorney, Agent, or Firm* — Michael J. McCandlish; Mindful IP PLLC

(57) ABSTRACT

A sports training accessory includes a belt, a clip, and a holder. The clip is disposed on the belt. The holder is rotatably attached to the clip and can move from a first position to a second position relative to the clip. The holder includes a basket for holding a ball used in a sporting activity. For example, the basket may be sized to hold a basketball, football, soccer ball, tennis ball, or the like.

7 Claims, 15 Drawing Sheets

(56) References Cited

U.S. PATENT DOCUMENTS

| | | | |
|---|---|---|---|
| 2008/0230580 | A1 | 9/2008 | Rothschild |
| 2009/0300818 | A1 | 12/2009 | Waite et al. |
| 2014/0143936 | A1 | 5/2014 | Flanagan |
| 2015/0209639 | A1 | 7/2015 | Bishop |
| 2017/0165531 | A1 | 6/2017 | Lynch |
| 2020/0179769 | A1 | 6/2020 | Oakes |

* cited by examiner

SPORTS TRAINING ACCESSORY

BACKGROUND

Many sports are played with a ball or another object in play. In many sports, manipulating the ball or other object is how an individual or team can score points. For instance, in basketball, points are scored by tossing the ball through a hoop. In football, points are scored by running, catching, or kicking a ball into a designated area. In bowling, points are scored by rolling a ball to knock over pins at the end of a lane. In soccer, points are scored by kicking a ball into a goal.

Many sports define or limit how the ball is to be handled during the game. For instance, in basketball, the ball may be dribbled and thrown but not kicked. In tennis, the ball must be hit with a racket. In golf, the ball must be hit with a club. In soccer, the rules for how a goalie may handle the ball are different from how a non-goalie may handle the ball.

DETAILED DESCRIPTION

At all levels of sports, from youth to professional, individuals and teams seek the help of coaches who can help players improve their ball handling technique. But practicing with a ball under the guidance of a coach is very different from handling the ball during a game or match. In many sports that use a ball or similar object, only one ball is in play at a time. For instance, in basketball, only one ball is present on the court at any given time during the game. That's not the case during practice, however. Basketball players may wish to repeatedly practice a shot from a certain spot on the court. They can practice more effectively if multiple balls are immediately available. Therefore, basketball players may move a rack of basketballs to the spot on the court where they wish to practice. Racks are not always available or practical, however. For instance, the rack may be in the way of running plays in sports like basketball, football, or soccer. In such cases, coaches or players will carry multiple balls and make those balls immediately available to players during practices. Carrying multiple balls is cumbersome and can create a hazard if, e.g., the coach drops one or more of the balls and causes a player to trip.

One solution involves a sports training accessory including a belt, a clip disposed on the belt, and a holder rotatably attached to the clip. In the first example, the holder includes a basket for holding a ball. That way, a coach can easily carry and provide multiple balls to players during practice.

The elements shown may take many different forms and include multiple and/or alternate components and facilities. The example components illustrated are not intended to be limiting. Indeed, additional or alternative components and/or implementations may be used. Further, the elements shown are not necessarily drawn to scale unless explicitly stated as such.

Figure 1:
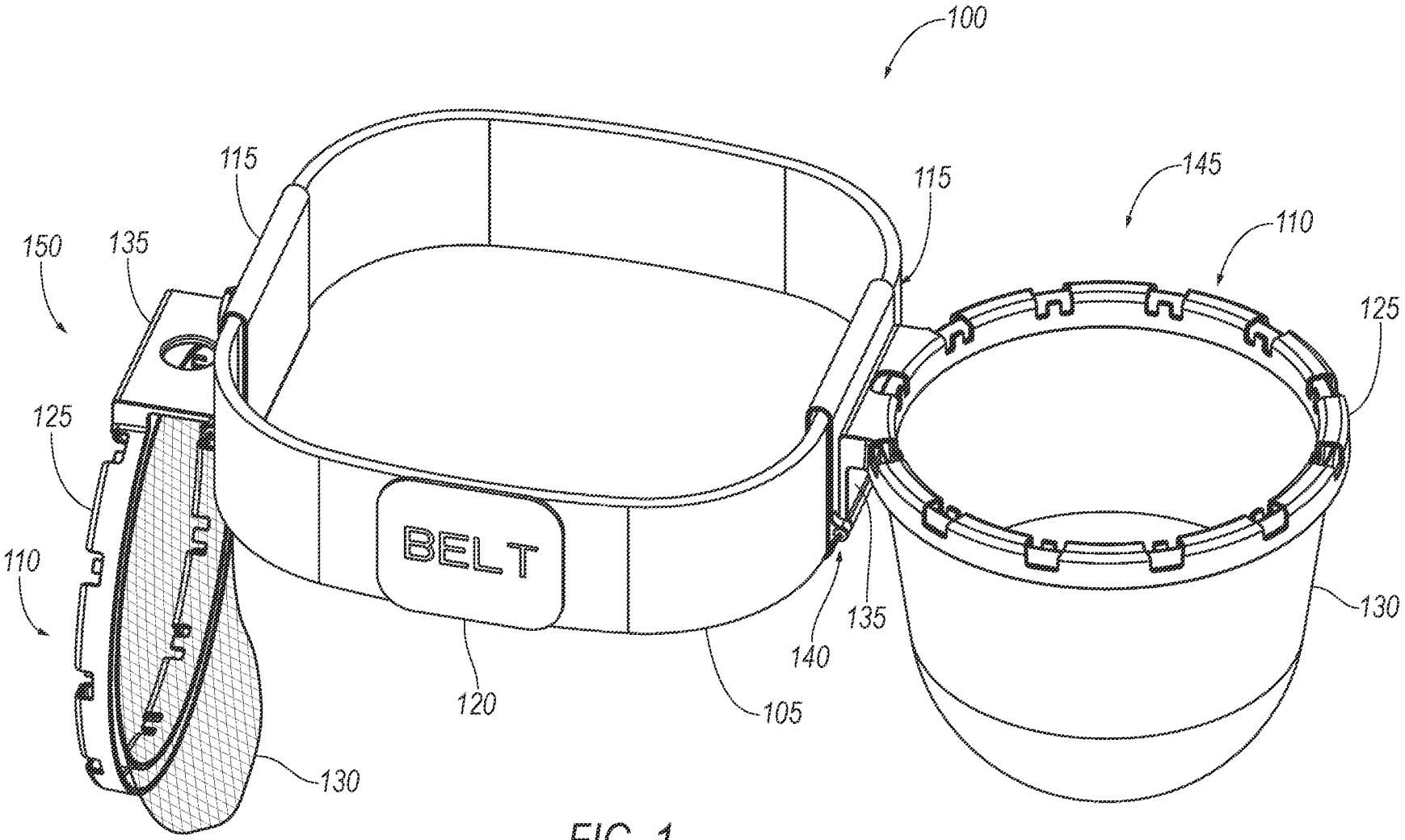
FIG. 1 illustrates a first example sports training accessory for holding multiple balls used in a sport.
Figure 2:
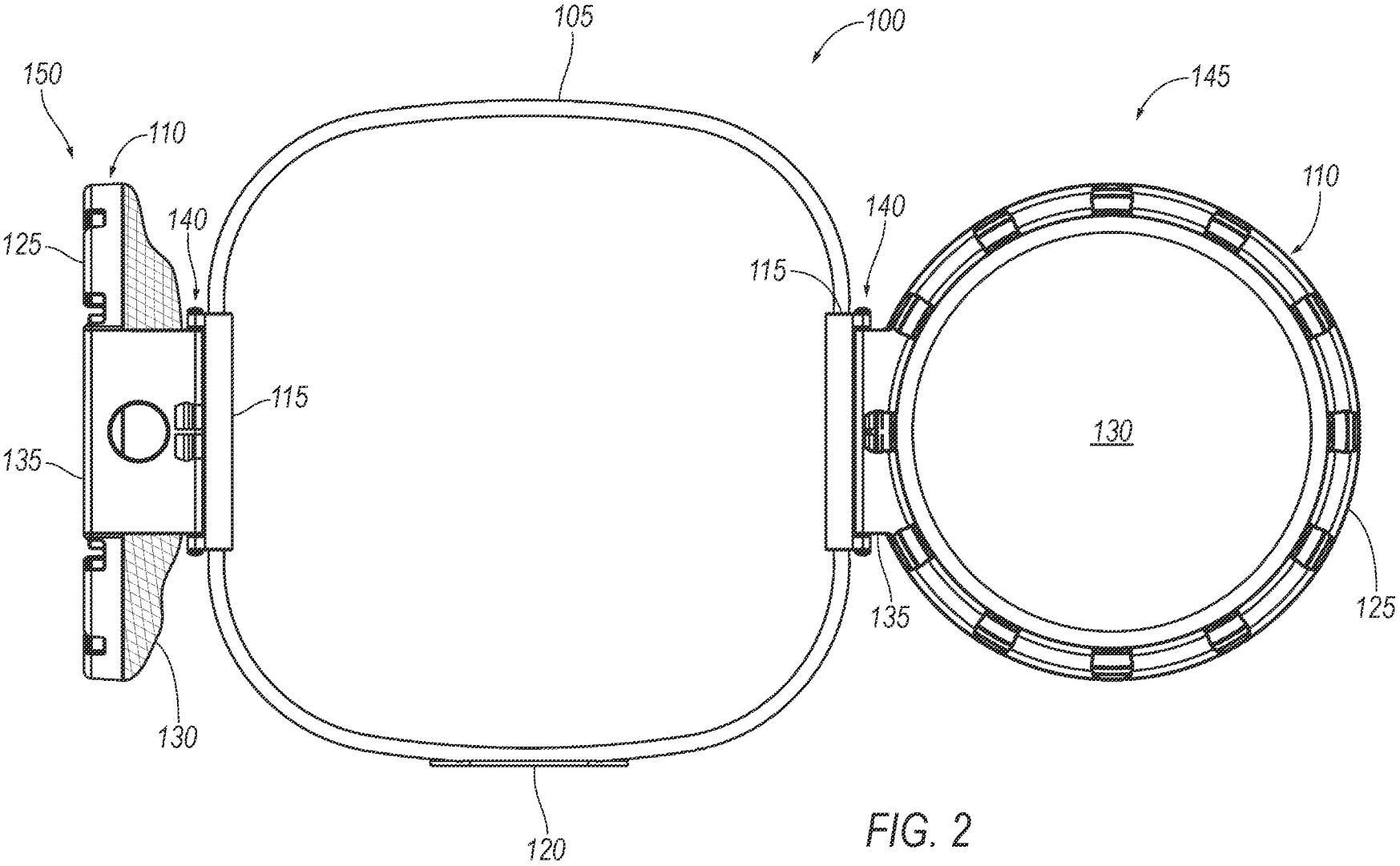
FIG. 2 is a top view of the example sports training accessory of FIG. 1.
Figure 3:
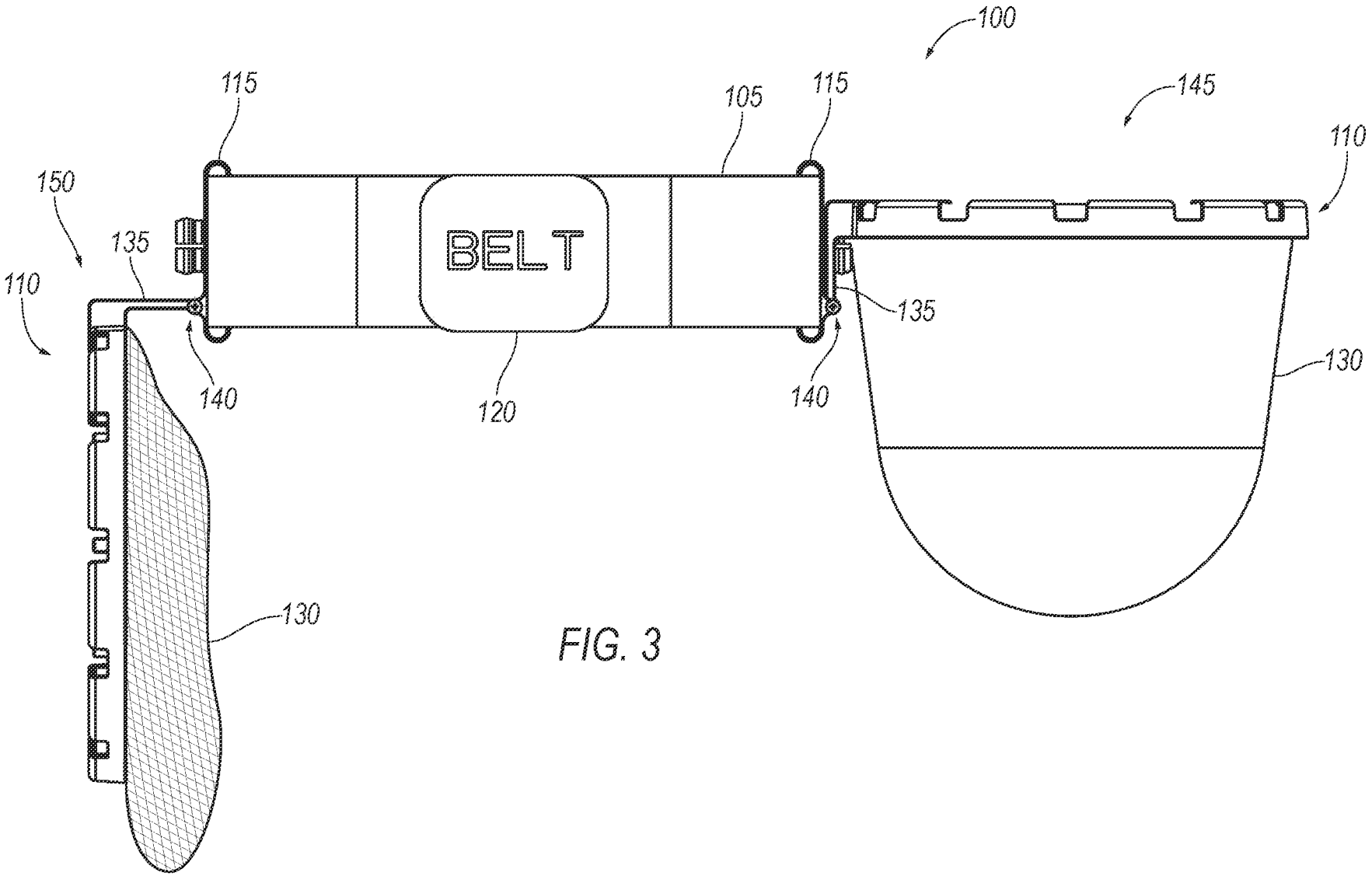
FIG. 3 is a side view of the example sports training accessory of FIG. 1.
Figure 4:
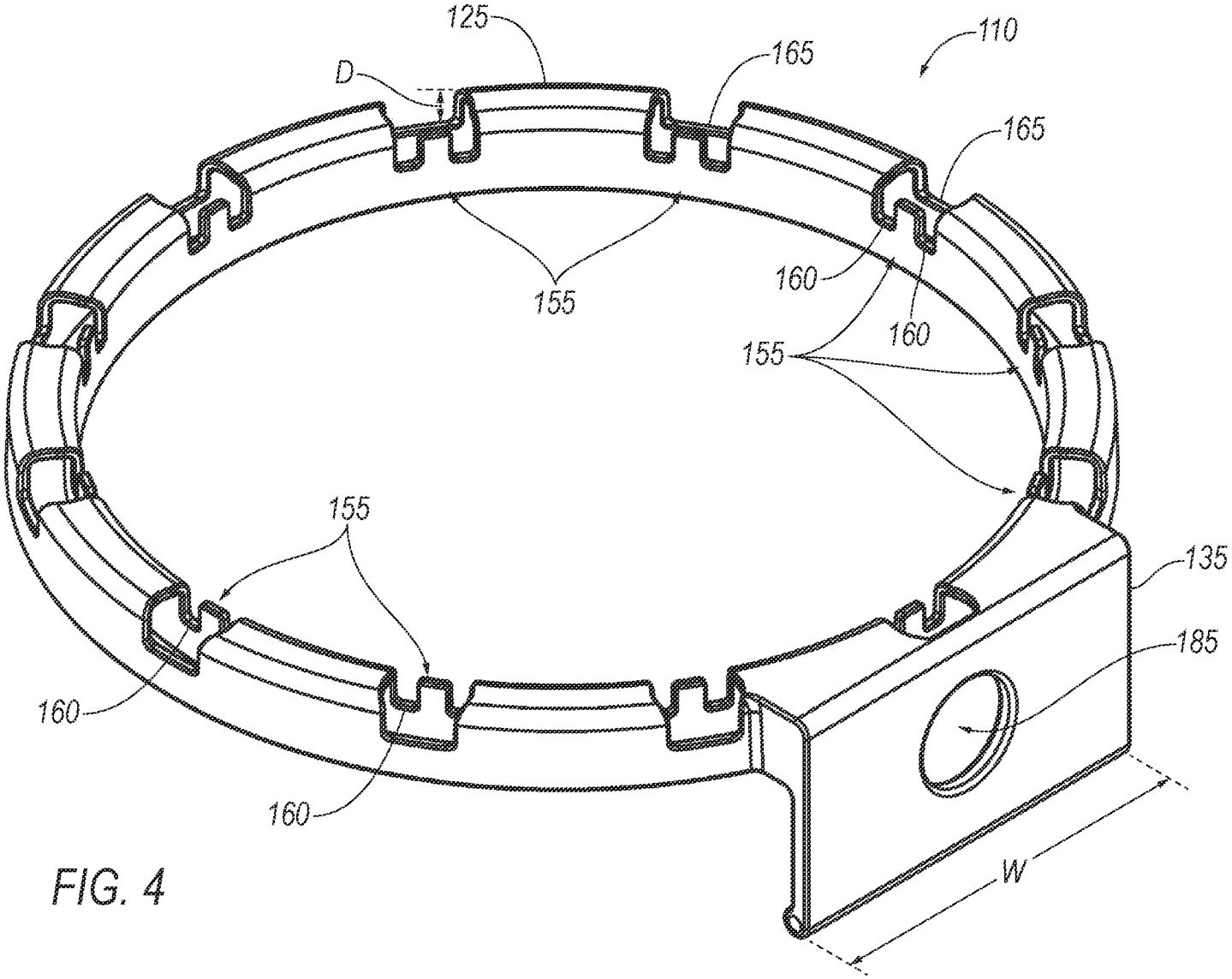
FIG. 4 is a perspective view of a first example holder that may be used with the example sports training accessory of FIG. 1.
Figure 5:
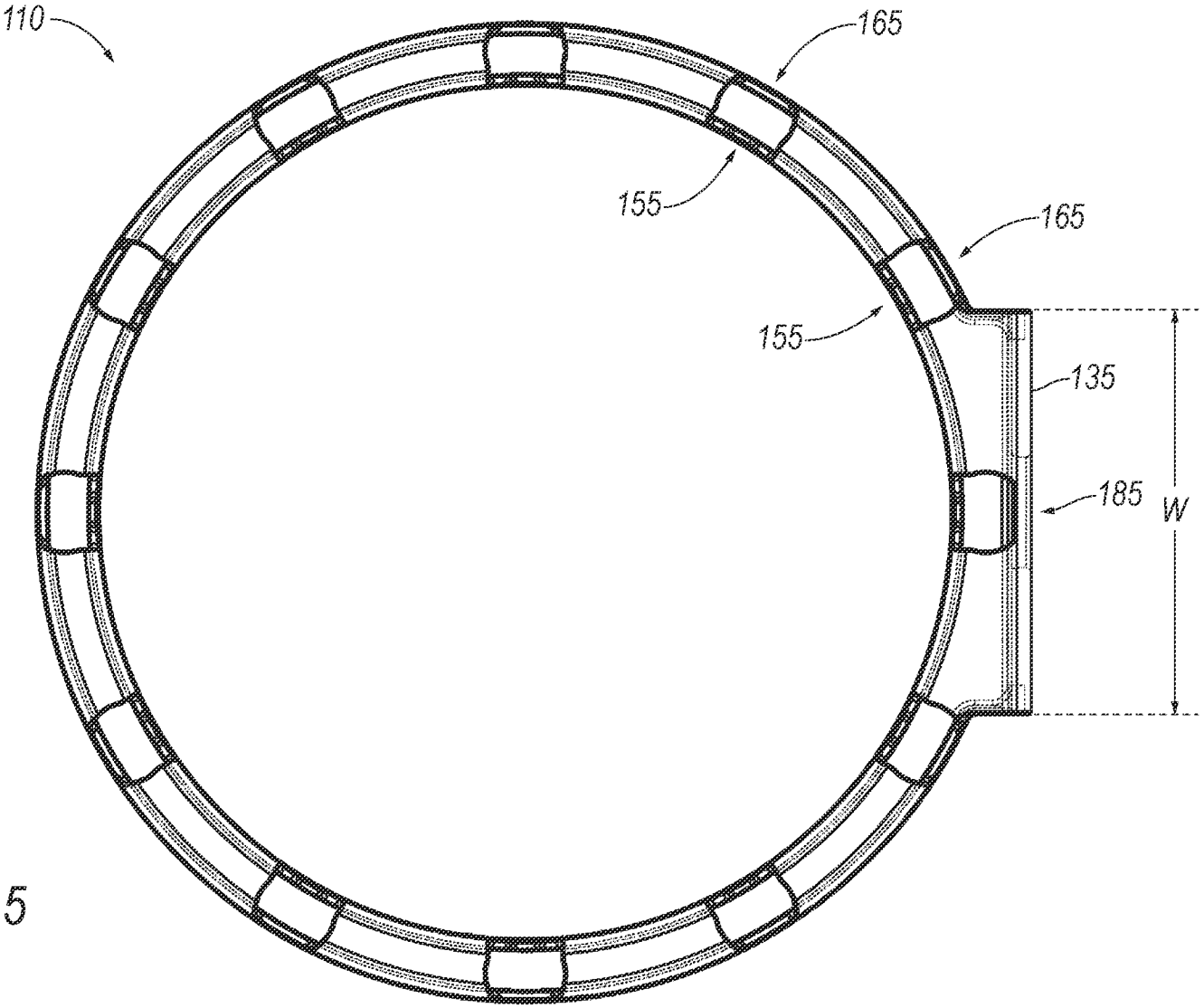
FIG. 5 is a top view of the first example holder of FIG. 4.
Figure 6:
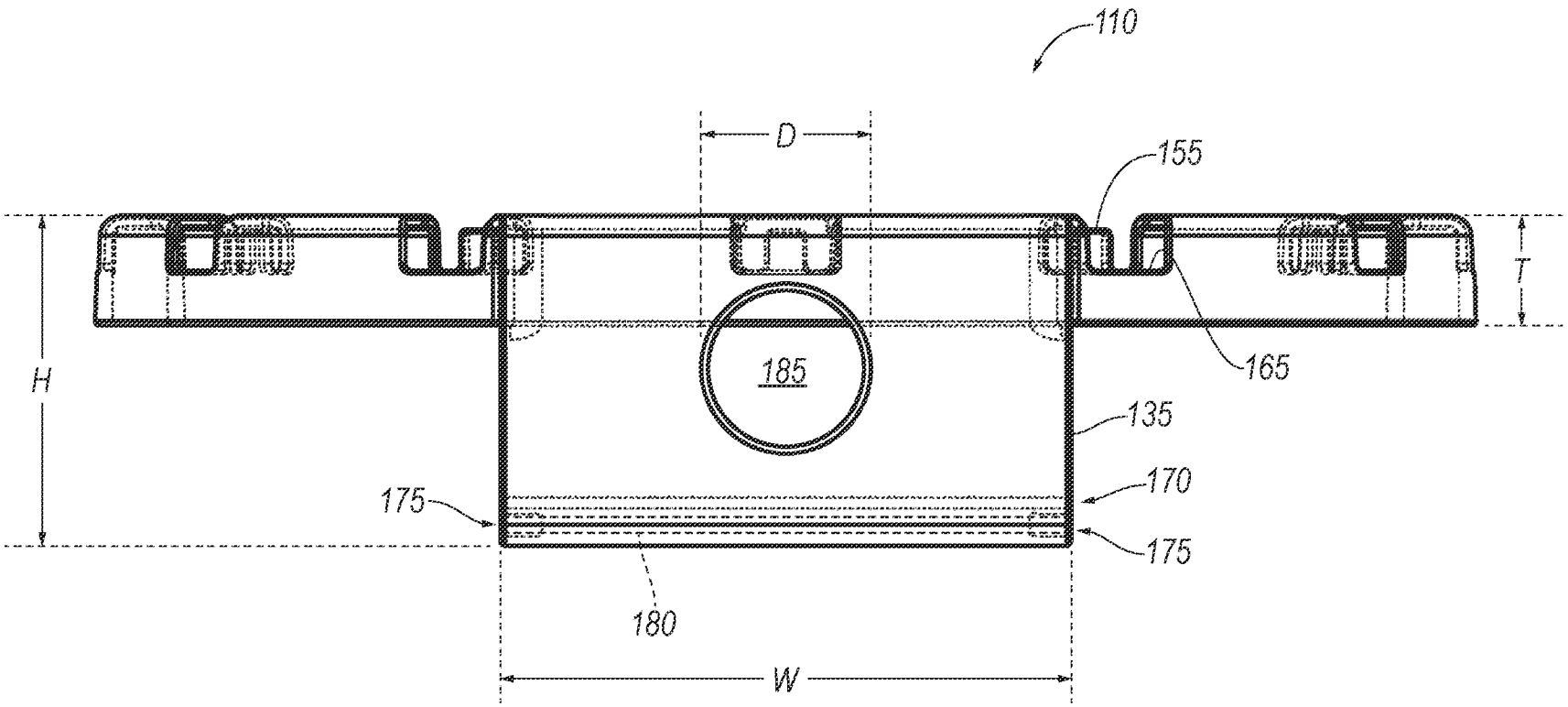
FIG. 6 is a front view of the first example holder of FIG. 4.
Figure 7:
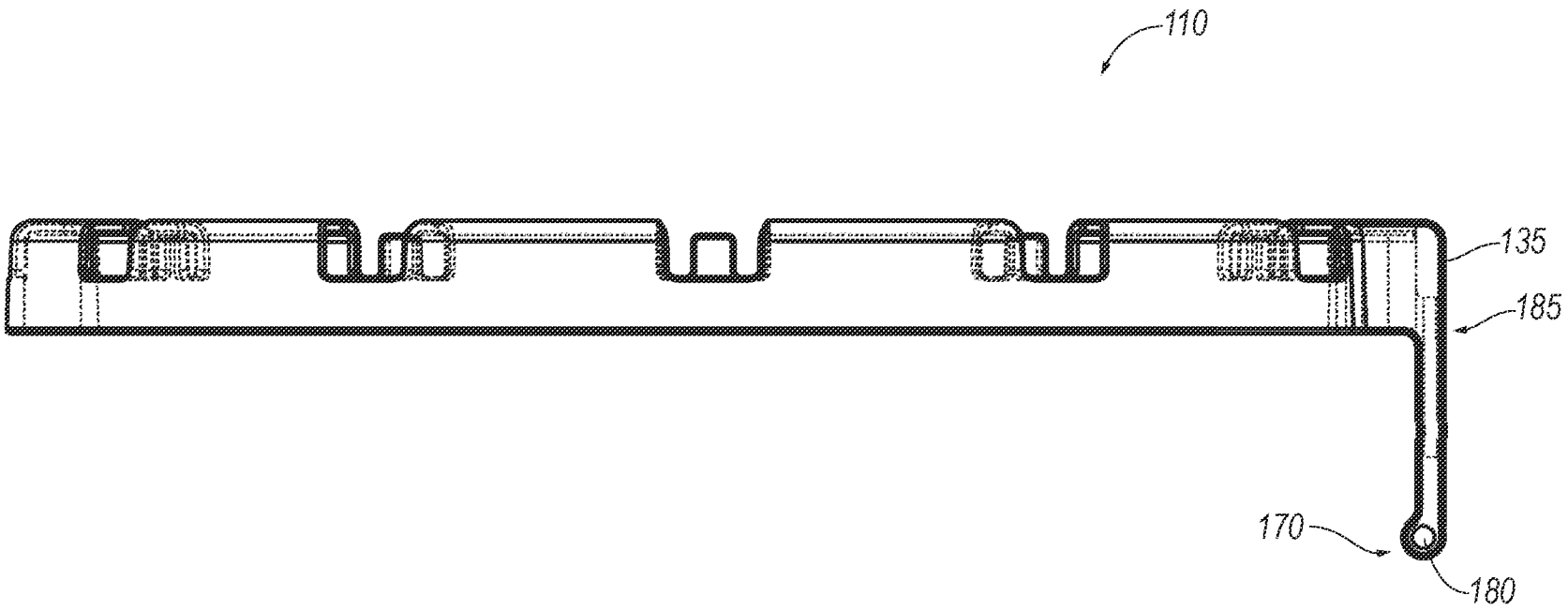
FIG. 7 is a side view of the first example holder of FIG. 4.
Figure 8:
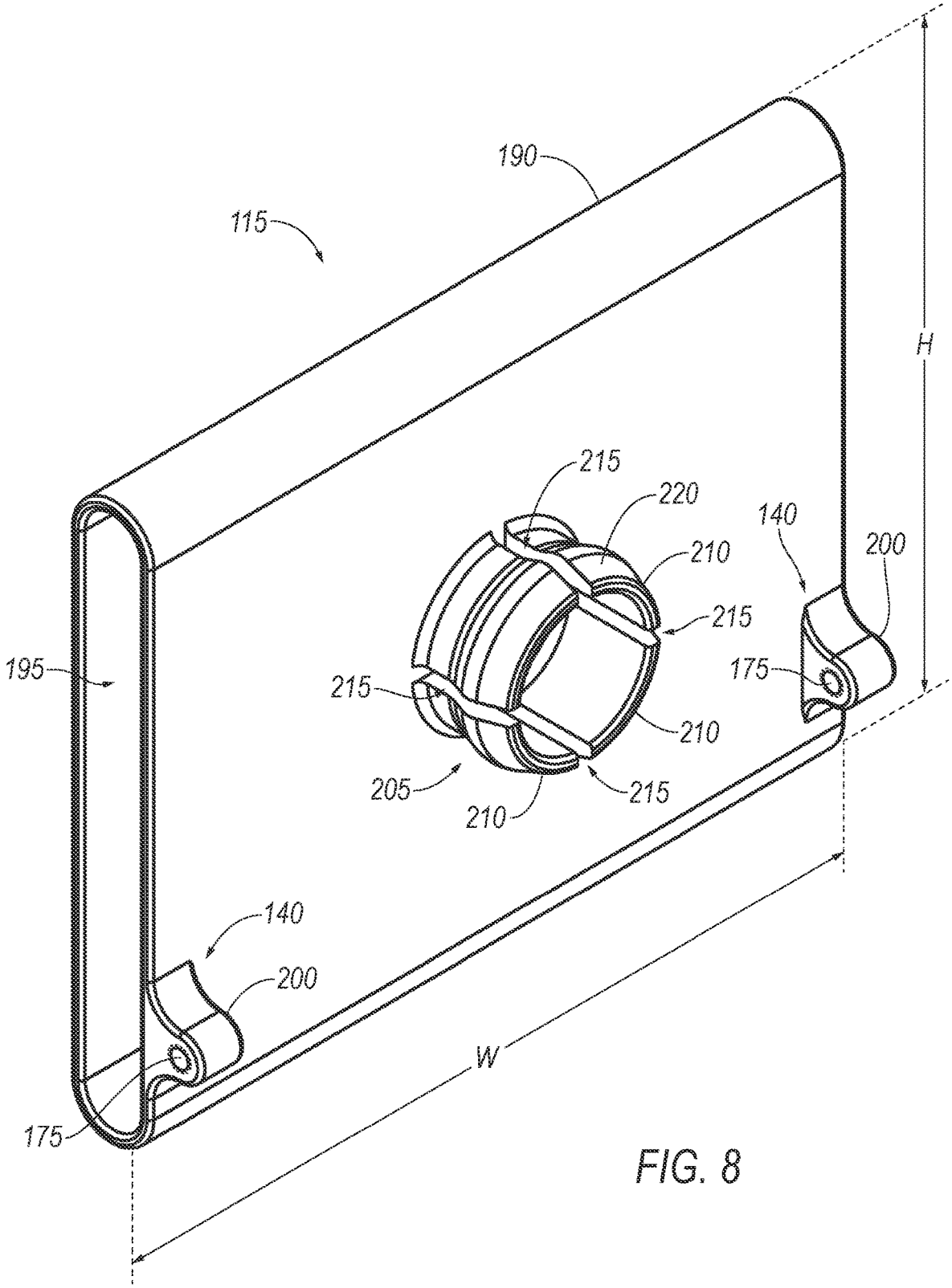
FIG. 8 is a perspective view of a first example clip that may be used with the example sports training accessory of FIG. 1.
Figure 9:
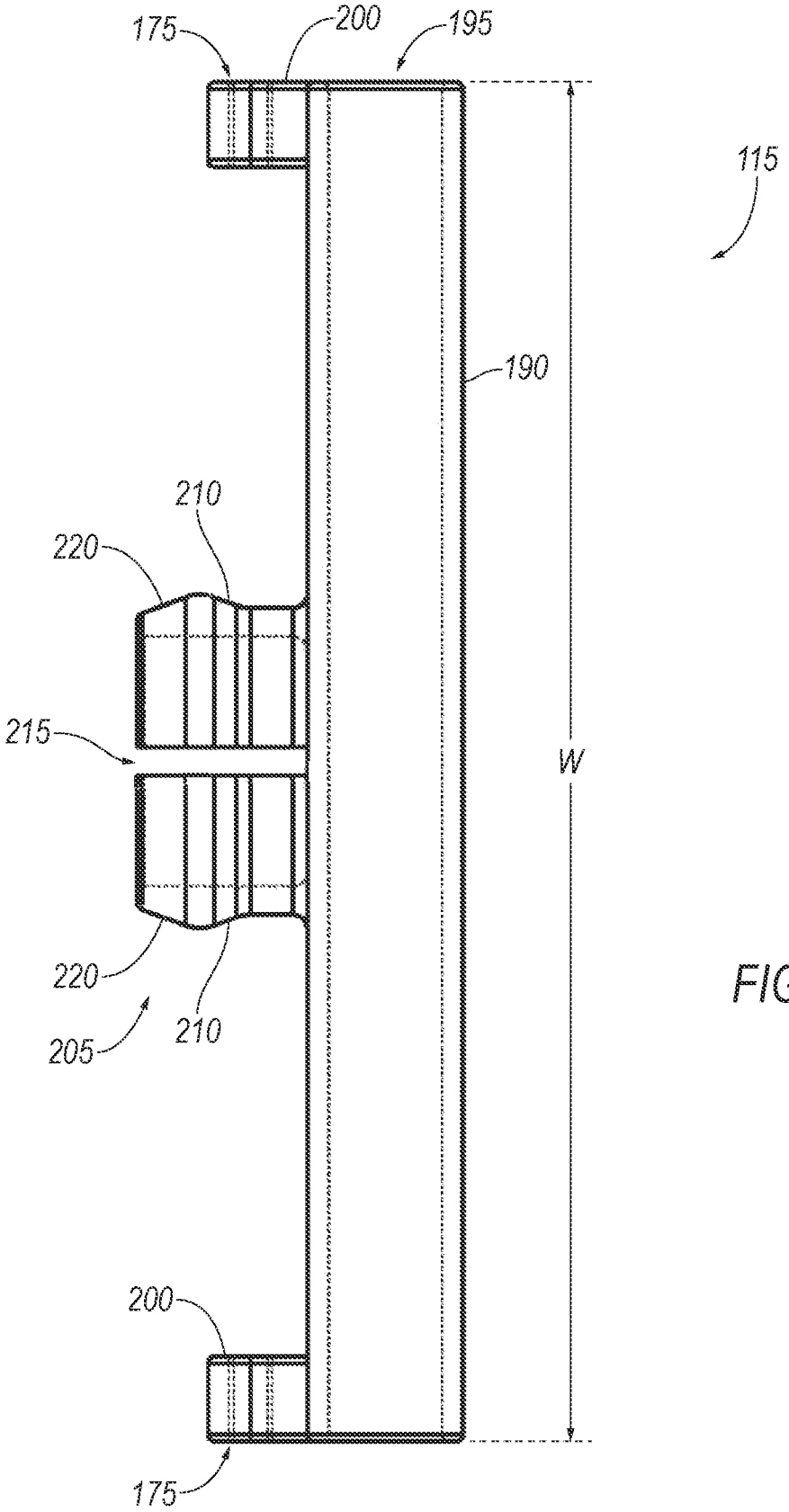
FIG. 9 is a top view of the first example clip of FIG. 8.
Figure 10:
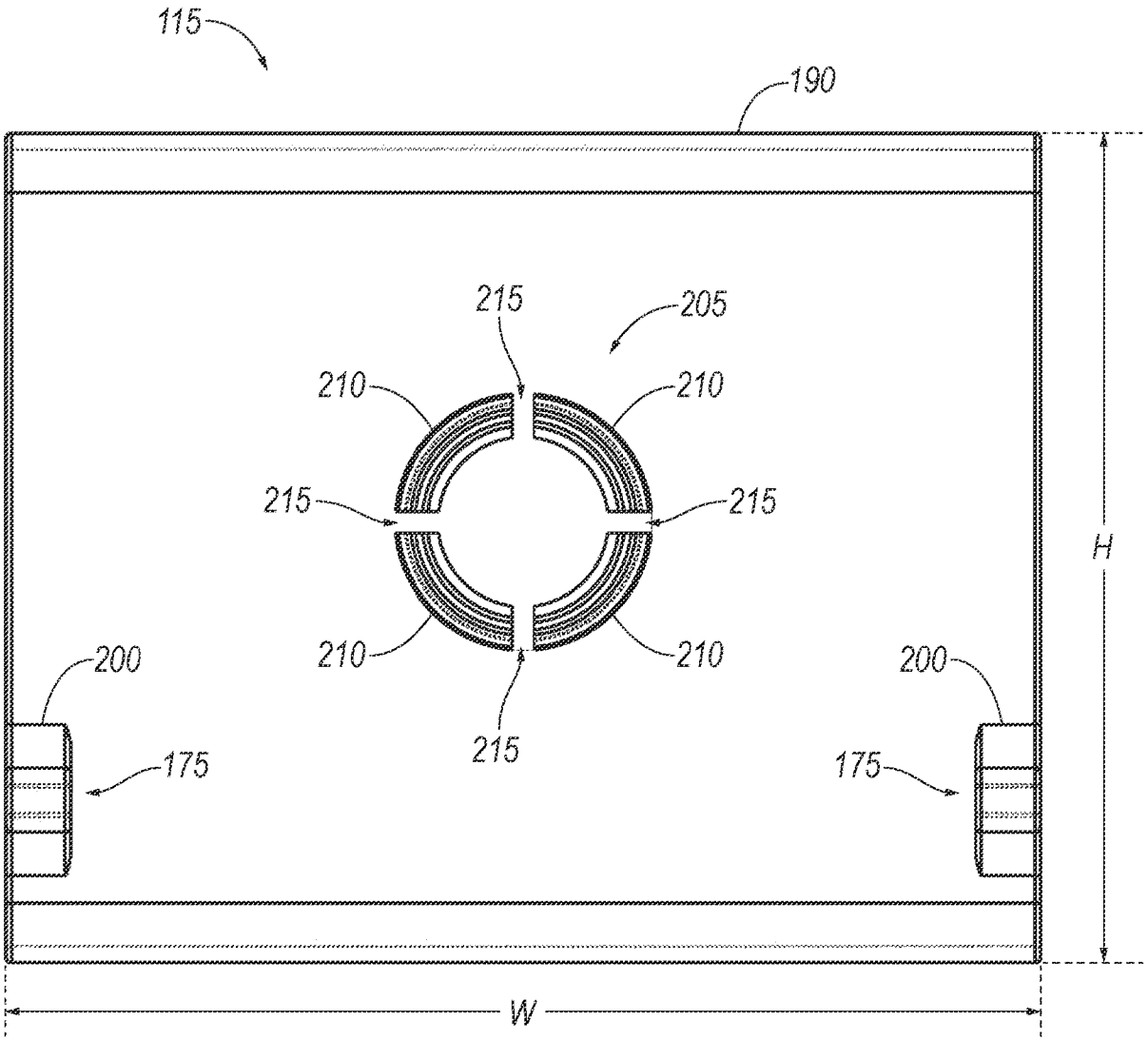
FIG. 10 is a front view of the first example clip of FIG. 8.
Figure 11:
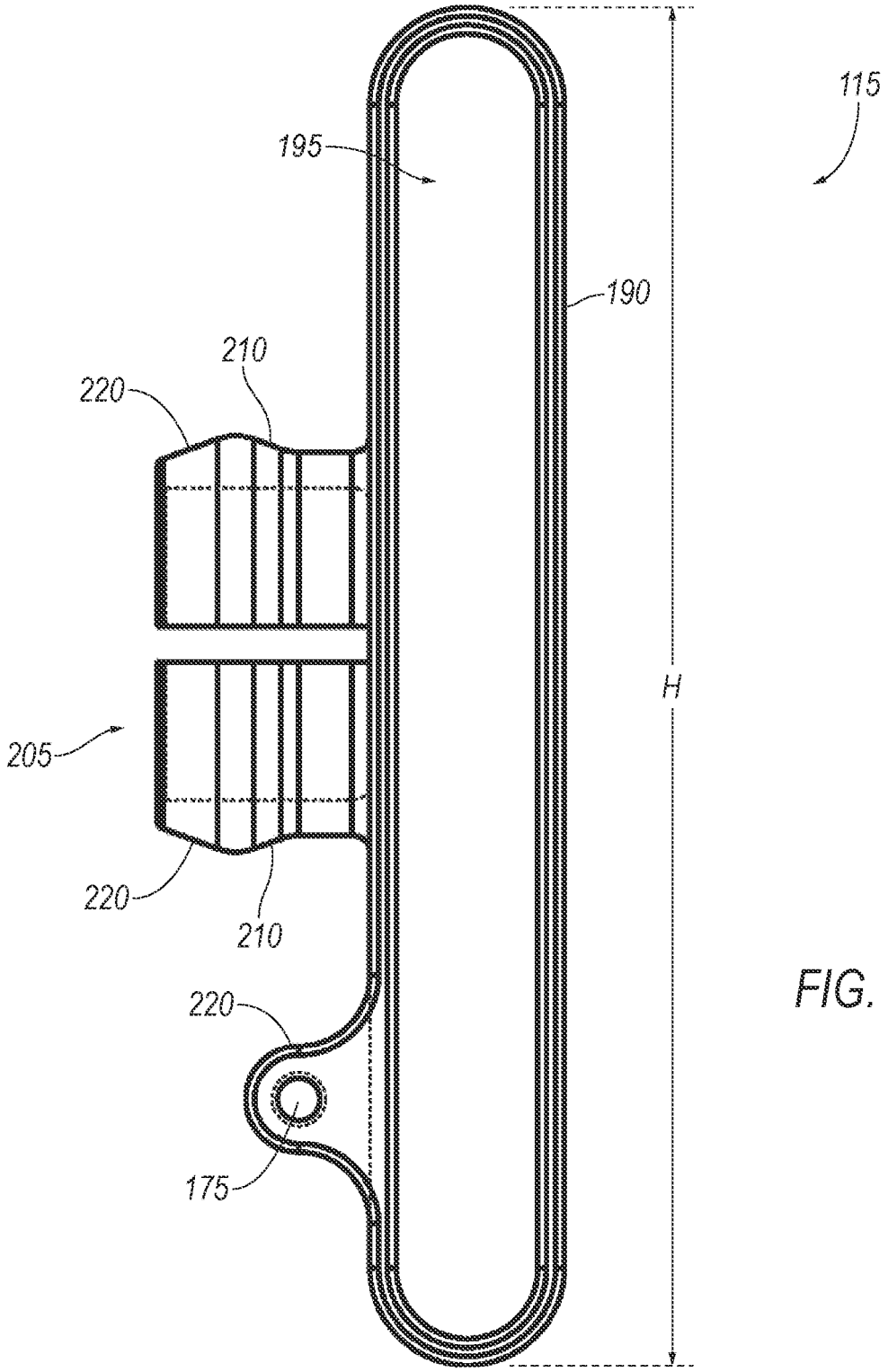
FIG. 11 is a side view of the first example clip of FIG. 8.

As illustrated in FIGS. 1-3, a sports training accessory 100 includes a belt 105, at least two holders 110, and a clip 115 for each holder 110. The sports training accessory 100 is configured to hold multiple balls at a time. When not being used to hold a ball, the sports training accessory 100 can be folded for the user's comfort or mobility. Moreover, folding the sports training accessory 100 to a smaller profile can make storage easier.

The belt 105 is formed of a flexible material such as leather, nylon, cloth, or another type of fabric. The belt 105 includes a buckle 120 for securing two ends of the belt 105 together to form a loop. When worn, the belt 105 may rest on a person's hips. The belt 105 may have a width W sufficient to support the holders 110, clips 115, and balls. For instance, the width of the belt 105 may be 2.5 in to 5.5 in. When used to hold larger balls such as basketballs, footballs, soccer balls, volley balls, or the like, the width of the belt 105 may be 4 in to 5.5 in. When use to hold smaller balls such as tennis balls, golf balls, lacrosse balls, or the like, the width of the belt 105 may be 2.5 in to 4 in. The length of the belt 105 may be associated with the size of the person wearing the belt 105 and the sizes of the holders 110, clips 115, and balls. The length of the belt 105 may be 30 in. to 56 in. or possibly smaller or larger. When the belt 105 is used with larger balls, a smaller length of the belt 105 means the belt 105 may support fewer clips 115 and holders 110, perhaps only one or two. A longer length of the belt 105 means the belt 105 may support more clips 115 and holders 110, such as three or more. The same principal is true for belts 105 used with smaller balls. In that instance, a smaller length of the belt 105 means the belt 105 may support fewer clips 115 and holders 110, perhaps only five to ten. A longer length of the belt 105 means the belt 105 may support more clips 115 and holders 110, such as eleven or more holders 110 and clips 115

Each holder 110 is formed from a loop 125, a basket 130, and a bracket 135. Each loop 125 may be formed from plastic, metal, or another rigid material strong enough to support the weight of the basket 130 and a ball. The size of each loop 125 is large enough to accommodate an intended ball. For instance, regulation basketballs have a circumference typically ranging from 16.0 in. to 29.5 in, which equates to a diameter ranging from approximately 5.1 in. to 9.4 in. The loops 125 may be 10-50% larger than the diameter of the ball. In the case of a size 7 basketball having a 29.5 in. circumference and 9.4 in. diameter, each loop 125 may have a diameter ranging from 10.3 in. to 14.1 in. Each basket 130 may be formed from a plastic, fabric, or polymer material (such as nylon). In some instances, the basket 130 is closed at the bottom to support a ball. In other instances, such as when the basket 130 is formed from plastic, the basket 130 is tapered to an opening having a size smaller than the diameter of the ball. In that case, the material forming the basket 130 is rigid enough that the ball will not pass through the opening. Two different types of baskets 130 are shown in FIGS. 1-4. For instance, the baskets 130 are shown as a net and a rigid bucket with a rounded bottom. Each bracket 135 may be disposed on one of the loops 125 and configured to engage one of the clips 115. In some instances, the bracket 135 is formed from the same material as the loop 125. In other instances, the bracket 135 may be formed from a different material as the loop 125. The bracket 135 is discussed in greater detail below.

The clips 115 are formed from a rigid material such as plastic or metal configured to connect the holder 110 to the belt 105. Therefore, the clips 115 may be disposed to the belt 105. For example, the clips 115 may be sewn, adhered, or otherwise fastened to the belt 105 using, e.g., rivets, screws, or bolts. Alternatively, the clips 115 may be movably attached to the belt 105. In some instances, such as when the loop 125 is not in use, the clips 115 may allow the loop 125 to fold down. Therefore, each clip 115 may include a hinge 140. The hinge 140 may rotatably connect the clip 115 to one of the holders 110 in a first position 145 and a second position 150. When in the first position 145, the clip 115 may be disposed on the bracket 135. That is, the clip 115 may snap or otherwise connect to the bracket 135, keeping the holder 110 in an upright position. When in the second position 150, the clip 115 may be disengaged from the bracket 135 and rotated about the hinge 140, placing the holder 110 in a folded position, making the sports training accessory 100 more comfortable when not being used to hold balls and giving the sports training accessory 100 a smaller profile for easy storage when not in use. Operation of the clip 115 relative to the bracket 135 is discussed in greater detail below.

FIGS. 4-7 illustrate views of the example holders 110 shown in the example sports training accessory 100 of FIGS. 1-3 but with the baskets 130 removed for purposes of clarity and simplicity. As shown, the loop 125 is generally circular when viewed from the top and may include supports 155 about a periphery of an inside or outside edge or surface of the loop 125. The supports 155 may take the form of hooks or other fasteners for, e.g., securing the basket 130 to the loop 125. With this arrangement, the basket 130 may be removable from the loop 125. Therefore, as baskets wear out or are unsuitable for the type of ball to be used with the sports training accessory 100, for instance, they can be easily replaced with a new basket 130 or one more suitable for the type of ball to be used with the sports training accessory 100. For instance, one type of basket 130 may be used when the sports training accessory 100 is used to hold basketballs while another type of basket 130 may be used when the sports training accessory 100 is used to hold footballs. In one possible implementation, the supports 155 are defined by indentations 160 on the inside edge of the loop 125. The supports 155 may be accessible via notches 165 defined by the outside edge of the loop 125. The depths D of each indentation 160 and notch 165 may be 25-75% of the thickness T of the loop 125. In some instances, the indentations 160 and notches 165 have the same depth. In other possible implementations, the indentations 160 and notches 165 have different depths.

The bracket 135 may be integrally formed with, fixed to, or removable from the loop 125. The bracket 135 may have a generally rectangular top and front surfaces. The bracket 135 may have a width W that is 25%-75% of the inner or outer diameter of the loop 125. As shown in the example of FIGS. 4-7, the width of the bracket 135 is 47% of the width of the inside diameter of the loop 125 and 41% of the outside diameter of the loop 125. The height H of the bracket 135 may be two to four times the thickness of the loop 125. As shown in the example of FIGS. 4-7, the height of the bracket 135 is three times the thickness of the loop 125. The thickness of the bracket 135 may be 5-15% of the height of the bracket 135. For instance, in the example of FIGS. 4-7, the thickness of the bracket 135 is 8% of the height of the bracket 135. A bottom portion 170 of the bracket 135 defines a hole 175 for receiving a pin 180. The bottom portion 170 is configured to engage the clip 115 (discussed in greater detail below), and the pin 180 is inserted into the hole 175 to form the hinge 140. A front surface of the bracket 135 defines an aperture 185 for engaging the clip 115, as discussed in greater detail below. A diameter D of the aperture 185 is approximately 20%-40% of the width of the bracket 135. For instance, in the example shown in FIGS. 4-7, the diameter of the aperture 185 is 27% of the width of the bracket 135. As shown, the aperture 185 is centered horizontally and vertically relative to the front surface of the bracket 135. In other possible approaches, the aperture 185 may be off-center horizontally, vertically, or both.

FIGS. 8-11 illustrate an example clip 115, which may be attached to the belt 105, for engaging the bracket 135 of the holder 110. The clip 115 may be attached to or integrally formed with a body 190 configured to fasten to the belt 105. For instance, the body 190 may define a slot 195 slightly larger than the width of the belt 105. The belt 105 may be passed through the slot 195 to attach the clip 115 to the belt 105. In some instances, the clip 115 may be movably attached to the belt 105, giving the user the ability to change the position of the clip 115, and therefore the holder 110, around the user's waist. When the clip 115 is movable, the body 190 may not be fixed to the belt 105 once the belt 105 is passed through the slot 195. In other instances, the body 190 may be fixed to the belt 105. For instance, the body 190 may be sewn, adhered, or otherwise fastened to the belt 105 using, e.g., rivets, screws, or bolts.

The height H and width W of the body 190 may be similar to the height and width of the bracket 135. The heights and widths of the body 190 and bracket 135 need not be identical, however. In the example shown in FIGS. 8-11, the body 190 has a height and width larger than those of the bracket 135. Rather, as explained above, the height of the body 190 may be a function of the width of the belt 105. For instance, the height of the body 190 may be, e.g., 10%-30% larger than the width of the belt 105. As shown in the examples of FIGS. 8-11, the height of the body 190 is 20% larger than the width of the belt 105. The width of the body 190 may be, but need not be, proportional to the width of the bracket 135. As shown in FIGS. 8-11, the width of the body 190 is 15% larger than the width of the bracket 135 (i.e., the width of the body 190 is 115% of the width of the bracket 135). The width of the body 190 may be anywhere from 50%-200% of the width of the bracket 135, however.

The hinge 140 includes two protuberances 200, each defining a hole 175, extending from the body 190. In some instances, the protuberances 200 may be integrally formed with the body 190. In other instances, the protuberances 200 may be separate pieces attached to the body 190 using a fastener such as a rivet, screw, or bolt. The protuberances 200 may be located near a bottom of the body 190 such that they align with the holes 175 of the bottom portion 170 of the bracket 135. When aligned, a pin 180 may be inserted into the holes 175 of the bottom portion 170 of the bracket 135 and the protuberances 200 to form the hinge 140 that allows the holder 110 to rotate relative to the belt 105.

The clip 115 further includes a snap-fit connector 205 extending from the body 190. The snap-fit connector 205 may be formed of multiple sections 210 with a space 215 therebetween. The space 215 allows the sections 210 to flex toward one another so the snap-fit connector 205 may be inserted into the aperture 185 of the bracket 135. The snap-fit connector 205 may define ribs that will keep the snap-fit connector 205 inserted into the bracket 135 until the user wishes to fold down the holder 110. The pieces of the snap-fit connector 205 may each include a cam surface 220. When the holder 110 is rotated about the hinge 140, the force of the inside surface of the bracket 135 that defines the aperture 185 against the cam surface 220 causes at least one piece of the snap-fit connector 205 to flex toward at least one other piece of the snap-fit connector 205, allowing the bracket 135 to be removed from the clip 115 which permits the holder 110 to rotate about the hinge 140.

Figure 12:
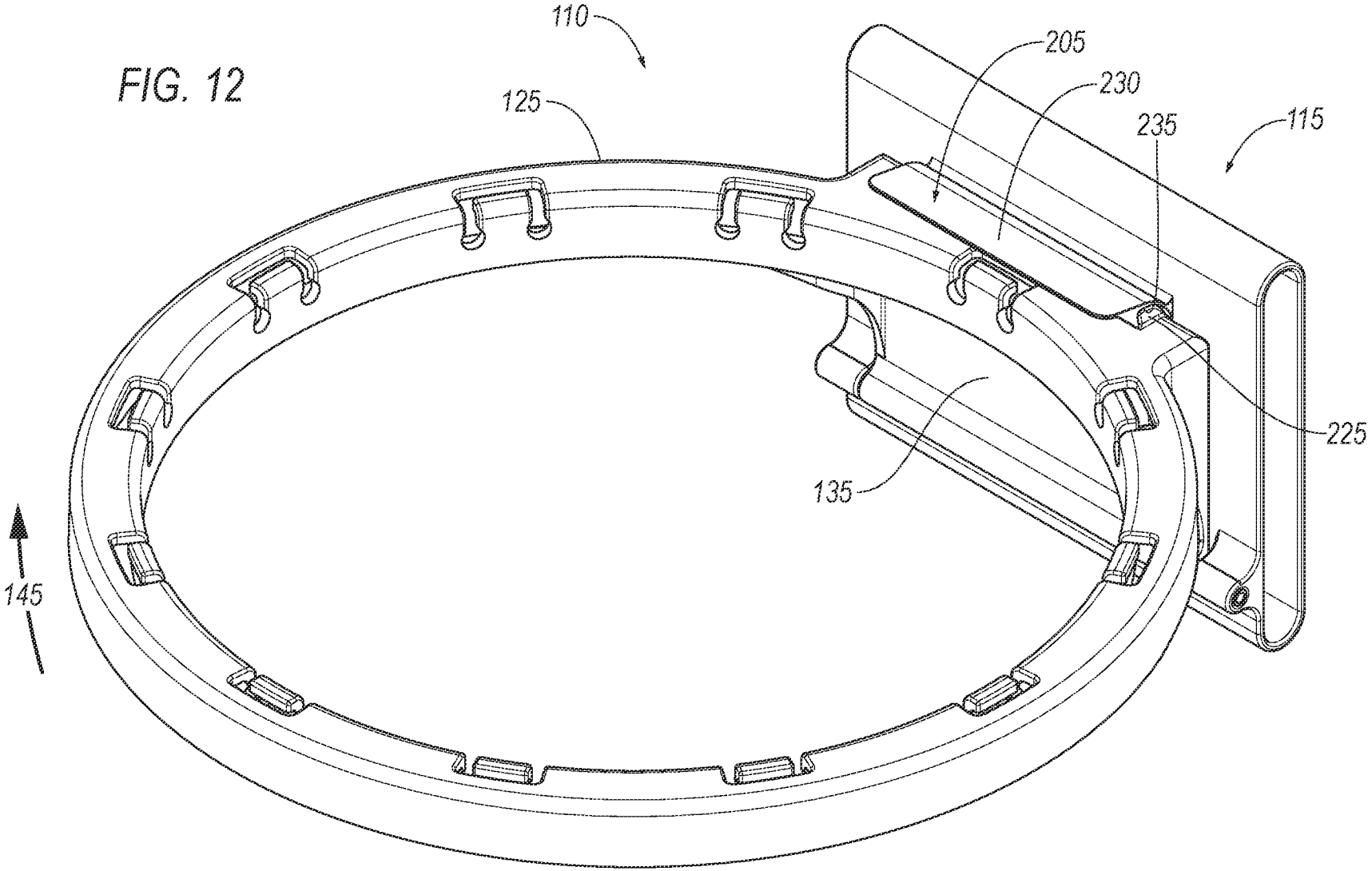
FIG. 12 is a perspective view of a second example holder and second example clip, in a first position, that may be used with the example sports training accessory of FIG. 1.

FIG. 12 is a perspective view of a second example holder 110 and second example clip 115, in a first position 145, that may be used with the example sports training accessory of FIG. 1. In this example implementation, the bracket 135 of the holder 110 has a bar 225, rather than an aperture 185, for engaging the snap-fit connector 205 of the clip 115. The bar 225 has a curved surface with a semi-circular cross-section. As shown in FIG. 12, the cross-section of the bar 225 is a quarter circle with three surfaces, namely two flat surfaces adjacent and perpendicular to one another with a curved surface therebetween.

As with implementations discussed above, the body 190 of the clip 115 includes the snap-fit connector 205. In this example approach, the snap-fit connector 205 includes a handle 230 and a flexible member 235 having a curved surface and a flat surface adjacent the curved surface.

When moving the loop 125 from the second position 150 to the first position 145, the flat surface of the flexible member 235 engages the curved surface of the bar 225. The curvature of the bar 225 causes the flexible member 235 to bend. When the flat surface of the flexible member 235 clears the curvature of the bar 225, the flexible member 235 snaps back to its original shape with the flat surface of the flexible member 235 adjacent the flat surface of the bar 225, securing the holder 110 in the first position 145. When in the first position 145, the curved surface of the bar 225 may be adjacent the curved surface of the flexible member 235 and one of the flat surfaces of the bar 225 may be adjacent the flat surface of the flexible member 235. To move the holder 110 to the second position 150, the handle 230 of the snap-fit connector 205 may be lifted to disengage the snap-fit connector 205 from the bar 225. Doing so will cause the holder 110 to disengage the clip 115.

Figure 13:
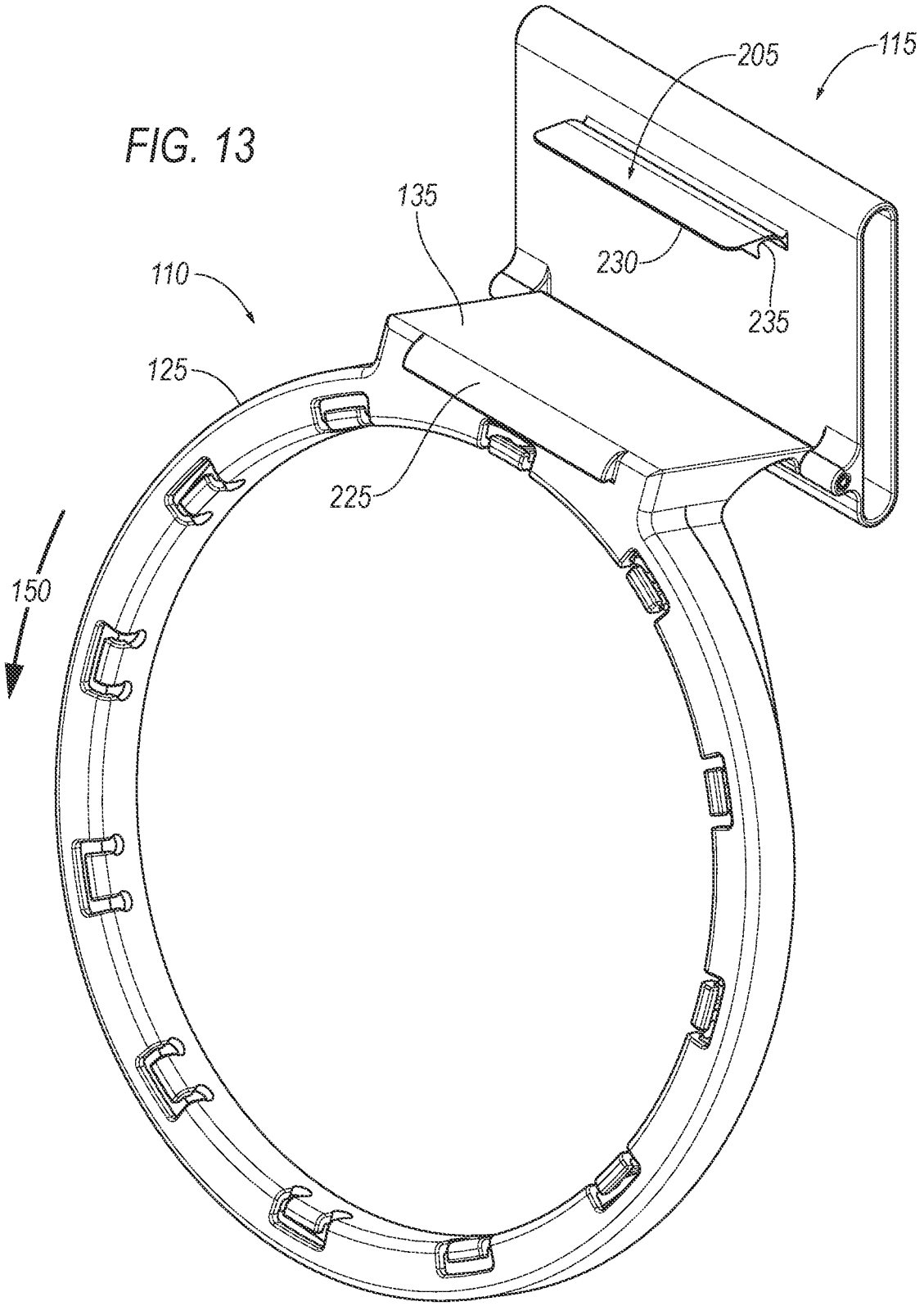
FIG. 13 is a perspective view of the second example holder and second example clip of FIG. 12 in a second position.
Figure 14:
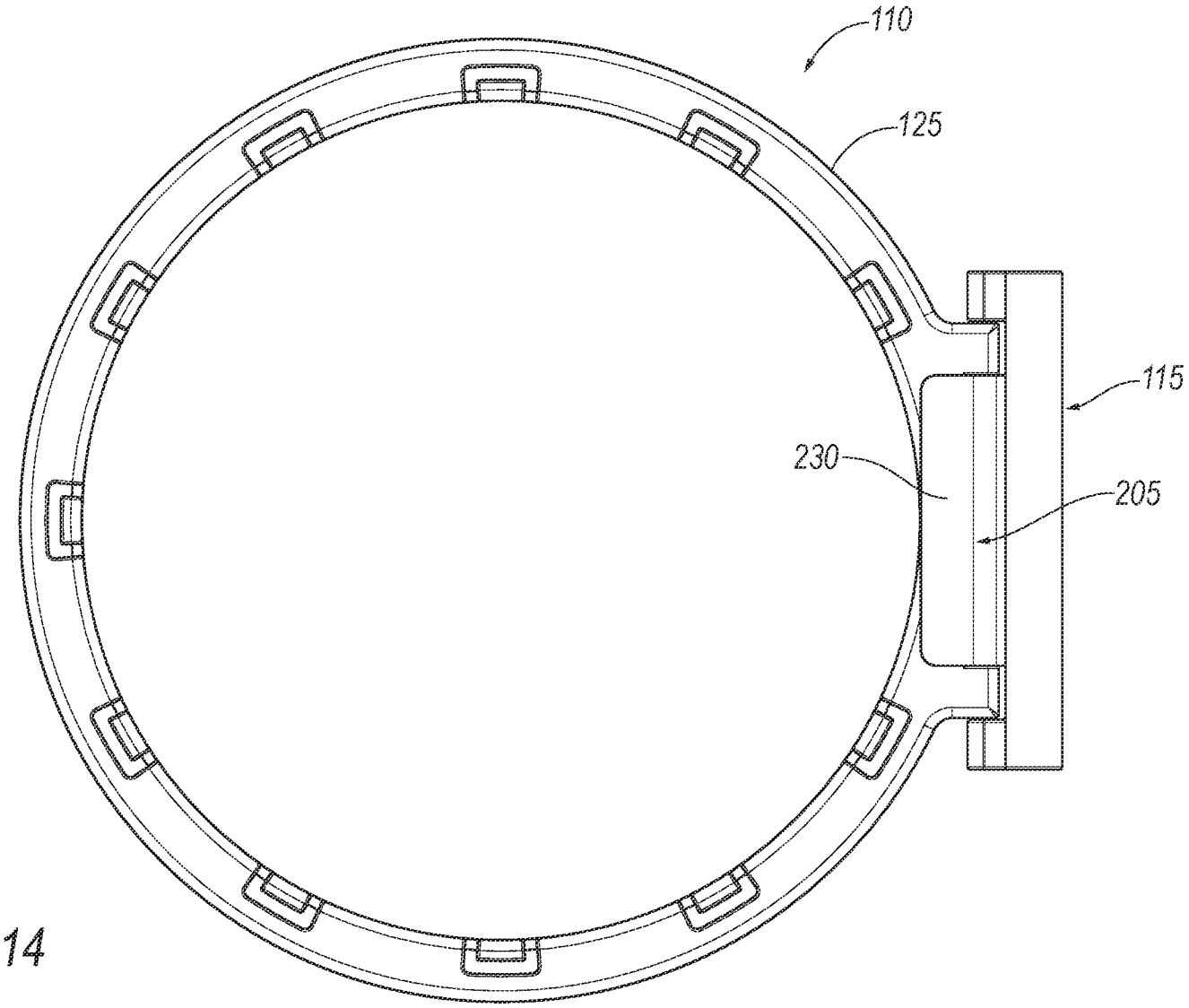
FIG. 14 is a top view of the second example holder and second example clip of FIGS. 12-13.
Figure 15:
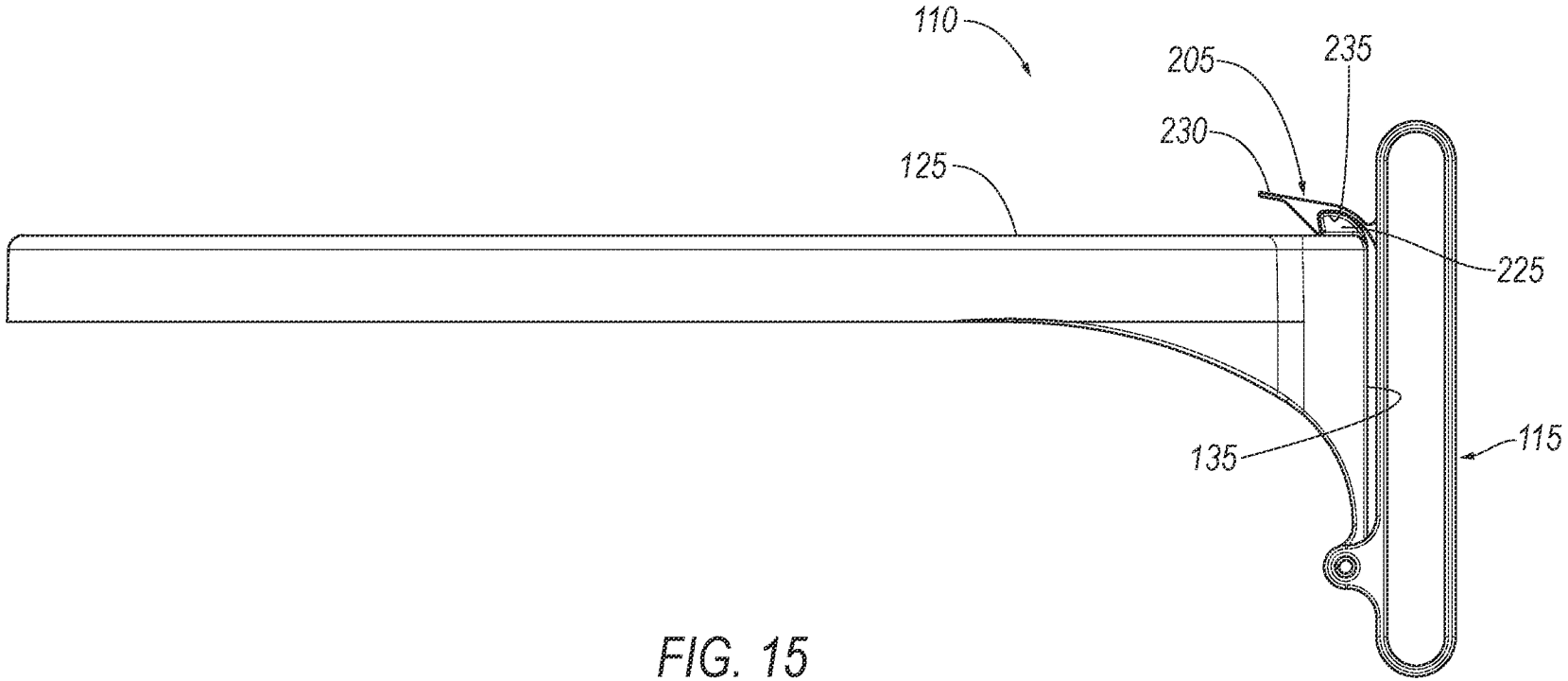
FIG. 15 is a side view of the second example holder and second example clip of FIGS. 12-13.

FIG. 13 is a perspective view of the second example holder 110 and second example clip 115 of FIG. 12 in the second position 150. FIG. 14 is a top view of the second example holder 110 and second example clip 115 of FIGS. 12-13. FIG. 15 is a side view of the second example holder 110 and second example clip 115 of FIGS. 12-13.

Example 1 of this disclosure pertains to a sports training accessory 100 including a belt 105, a clip 115 disposed on the belt 105, and a holder 110 rotatably attached to the clip 115. The holder 110 can move from a first position 145 to a second position 150 relative to the clip 115. In the first example, the holder 110 includes a basket 130 for holding a ball.

Example 2 of this disclosure pertains to the sports training accessory 100 of the Example 1, wherein the holder 110 includes a bracket 135 rotatably attached to the clip 115.

Example 3 of this disclosure pertains to the sports training accessory 100 of Example 2, wherein the bracket 135 includes a bottom portion 170 defining a hole 175 for receiving a pin 180.

Example 4 of this disclosure pertains to the sports training accessory 100 of Example 3, wherein the bracket 135 is configured to rotate about the pin 180 to engage the clip 115.

Example 5 of this disclosure pertains to the sports training accessory 100 of Example 4, wherein the bracket 135 defines an aperture 185 configured to engage the clip 115.

Example 6 of this disclosure pertains to the sports training accessory 100 of Example 5, wherein the clip 115 includes a body 190 having at least two protuberances 200.

Example 7 of this disclosure pertains to the sports training accessory 100 of Example 6, wherein each protuberance 200 defines a hole 175 for receiving the pin 180 to form a hinge 140.

Example 8 of this disclosure pertains to the sports training accessory 100 of Example 6, wherein the body 190 includes a snap-fit connector 205 configured to engage the aperture 185 of the bracket 135.

Example 9 of this disclosure pertains to the sports training accessory 100 of Example 8, wherein the snap-fit connector 205 includes a cam surface 220.

Example 10 of this disclosure pertains to the sports training accessory 100 of Example 8, wherein the snap-fit connector 205 includes a plurality of sections 210 with a space 215 therebetween.

Example 11 of this disclosure pertains to the sports training accessory 100 of Example 2, wherein the holder 110 includes a loop 125 attached to the bracket 135 and wherein the basket 130 is disposed on the loop 125.

Example 12 of this disclosure pertains to the sports training accessory 100 of Example 11, wherein the loop 125 includes a plurality of supports 155 disposed about a periphery of an edge of the loop 125.

Example 13 of this disclosure pertains to the sports training accessory 100 of Example 12, wherein the basket 130 is configured to attach to the loop 125 via the plurality of supports 155.

Example 14 of this disclosure pertains to the sports training accessory 100 of Example 12, wherein each support is defined by indentations 160 on a first edge of the loop 125, and wherein a second edge of the loop 125 defines a notch 165 aligned with the indentations 160.

Example 15 of this disclosure pertains to the sports training accessory 100 of example 2, wherein the bracket 135 includes a bar 225 and wherein the clip 115 includes a snap-fit connector 205 configured to engage the bar 225 disposed on the bracket 135.

Example 16 of this disclosure pertains to the sports training accessory 100 of example 15, wherein the snap-fit connector 205 includes a handle 230 and a flexible member 235, and wherein the flexible member 235 is configured to engage the bar 225.

Example 17 of this disclosure pertains to the sports training accessory 100 of example 16, wherein the flexible member 235 and the bar 225 each have a curved surface and a flat surface.

Example 18 of this disclosure pertains to the sports training accessory 100 of example 17, wherein the curved surface of the flexible member 235 and the curved surface of the bar 225 are adjacent to one another when the holder 110 is in the first position 145.

Example 19 of this disclosure pertains to the sports training accessory 100 of Example 1, wherein the clip 115 includes a body 190 forming a slot 195 for receiving the belt 105.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their ordinary meanings as understood by those knowledgeable in the technologies described herein unless an explicit indication to the contrary is made herein. In particular, use of the singular articles such as "a," "the," "said," etc. should be read to recite one or more of the indicated elements unless a claim recites an explicit limitation to the contrary.

The Abstract is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

The invention claimed is:

1. A sports training accessory comprising:

a belt;

a clip disposed on the belt; and a holder rotatably attached to the clip for moving the holder from a first position to a second position relative to the clip, wherein the holder includes a basket for holding a ball;

wherein the holder includes a bracket rotatably attached to the clip;

wherein the bracket includes a bottom portion defining a hole for receiving a pin;

wherein the bracket is configured to rotate about the pin to engage the clip;

wherein the bracket defines an aperture configured to engage the clip, wherein the clip includes a body having at least two protuberances; and wherein the body includes a snap-fit connector configured to engage the aperture of the bracket.

2. The sports training accessory of claim 1, wherein the snap-fit connector includes a cam surface.

3. The sports training accessory of claim 1, wherein the snap-fit connector includes a plurality of sections with a space therebetween.

4. A sports training accessory comprising:

a belt;

a clip disposed on the belt;

a holder rotatably attached to the clip for moving the holder from a first position to a second position relative to the clip, wherein the holder includes a basket for holding a ball;

wherein the holder includes a bracket rotatably attached to the clip;

wherein the holder includes a loop attached to the bracket and wherein the basket is disposed on the loop, and wherein the loop includes a plurality of supports disposed about a periphery of an edge of the loop; and wherein each support is defined by indentations on a first edge of the loop, and wherein a second edge of the loop defines a notch aligned with the indentations.

5. A sports training accessory comprising:

a belt;

a clip disposed on the belt;

a holder rotatably attached to the clip for moving the holder from a first position to a second position relative to the clip, wherein the holder includes a basket for holding a ball;

wherein the holder includes a bracket rotatably attached to the clip;

wherein the bracket includes a bar;

wherein the clip includes a snap-fit connector configured to engage the bar disposed on the bracket; and wherein the snap-fit connector includes a handle and a flexible member, and wherein the flexible member is configured to engage the bar.

6. The sports training accessory of claim 5, wherein the flexible member and the bar each have a curved surface and a flat surface.

7. The sports training accessory of claim 6, wherein the curved surface of the flexible member and the curved surface of the bar are adjacent to one another when the holder is in the first position.

* * * * *